US007306701B2

(12) United States Patent
Blum et al.

(10) Patent No.: US 7,306,701 B2
(45) Date of Patent: Dec. 11, 2007

(54) PRODUCTION OF PAPER, BOARD AND CARDBOARD

(75) Inventors: Rainer Blum, Mannheim (DE); Ralf Hemel, Worms (DE); Norbert Mahr, Limburgerhof (DE); Rudolf Lorz, Lambsheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/523,417

(22) PCT Filed: Jul. 23, 2003

(86) PCT No.: PCT/EP03/08037

§ 371 (c)(1),
(2), (4) Date: Feb. 3, 2005

(87) PCT Pub. No.: WO2004/015200

PCT Pub. Date: Feb. 19, 2004

(65) Prior Publication Data

US 2005/0247420 A1 Nov. 10, 2005

(30) Foreign Application Priority Data

Aug. 7, 2002 (DE) ..... 102 36 252

(51) Int. Cl.
*D21H 17/45* (2006.01)
*D21H 21/10* (2006.01)

(52) U.S. Cl. ..... 162/168.3; 162/158; 162/168.1; 162/168.2; 162/181.6; 162/181.8

(58) Field of Classification Search ..... 162/158, 162/168.1, 168.2, 168.3, 181.6, 181.8
See application file for complete search history.

(56) References Cited

U.S. PATENT DOCUMENTS

| | | | | |
|---|---|---|---|---|
| 3,052,595 | A | 9/1962 | Pye | |
| 4,749,444 | A * | 6/1988 | Lorz et al. | 162/168.3 |
| 4,913,775 | A * | 4/1990 | Langley et al. | 162/164.3 |
| 4,964,955 | A * | 10/1990 | Lamar et al. | 162/164.6 |
| 5,015,334 | A | 5/1991 | Derrick | |
| 5,266,164 | A | 11/1993 | Novak et al. | |
| 5,393,381 | A | 2/1995 | Hund et al. | |
| 5,529,699 | A * | 6/1996 | Kuo et al. | 210/735 |
| 5,676,796 | A * | 10/1997 | Cutts | 162/158 |
| 5,690,789 | A * | 11/1997 | Small et al. | 162/134 |
| 6,103,065 | A * | 8/2000 | Humphreys et al. | 162/181.8 |
| 6,238,521 | B1 | 5/2001 | Shing et al. | |
| 6,361,653 | B2 * | 3/2002 | Keiser et al. | 162/181.6 |
| 6,379,501 | B1 * | 4/2002 | Zhang et al. | 162/181.7 |
| 2002/0066540 | A1 * | 6/2002 | Chen et al. | 162/17 |

FOREIGN PATENT DOCUMENTS

| | | |
|---|---|---|
| EP | 0 017 353 | 10/1980 |
| EP | 0235893 A1 * | 1/1987 |
| EP | 0 223 223 | 5/1987 |
| EP | 0 235 893 | 9/1987 |
| EP | 0 335 575 | 10/1989 |
| EP | 0 608 986 | 8/1994 |
| EP | 0 711 371 | 5/1996 |
| EP | 0 885 328 | 12/1998 |
| EP | 0 910 701 | 4/1999 |
| WO | 99 63159 | 12/1999 |
| WO | 99 66130 | 12/1999 |
| WO | 01 34910 | 5/2001 |

* cited by examiner

*Primary Examiner*—Steven P. Griffin
*Assistant Examiner*—Dennis R. Cordray
(74) *Attorney, Agent, or Firm*—Oblon, Spivak, McClelland, Maier & Neustadt, P.C.

(57) ABSTRACT

Paper, board and cardboard are produced by shearing the paper stock, adding a microparticle system comprising a cationic polymer and a finely divided inorganic component to the paper stock after the last shearing stage before the head box, draining the paper stock with sheet formation and drying the sheets, by a process in which cationic polyacrylamides, polymers containing vinylamine units and/or polydiallyldimethylammonium chloride having an average molar mass Mw of in each case at least 500 000 Dalton and a charge density of in each case not more than 4.0 meq/g are used as cationic polymers of the microparticle system.

8 Claims, No Drawings

PRODUCTION OF PAPER, BOARD AND CARDBOARD

CROSS REFERENCES TO RELATED APPLICATIONS

This application is a national stage application of International Patent Application No. PCT/EP03/08037, filed on Jul. 23, 2003, and claims priority to German Patent Application No. 102 36 252.1, filed on Aug. 7, 2002, both of which are incorporated herein by reference in their entireties.

The present invention relates to a process for the production of paper, board and cardboard by shearing the paper stock, adding a microparticle system comprising a cationic polymer and a finely divided inorganic component to the paper stock after the last shearing stage before the head box, draining the paper stock with sheet formation and drying the sheets.

The use of combinations of nonionic or anionic polymers and bentonite as retention aids in the production of paper is disclosed, for example, in U.S. Pat. No. 3,052,595 and EP-A-0 017 353.

EP-A-0 223 223 discloses a process for the production of paper and board by draining a-paper stock, first bentonite being added to a paper stock having a consistency of from 2.5 to 5% by weight, the paper stock then being diluted, a highly cationic polymer having a charge density of at least 4 meq/g being added and finally a high molecular weight polymer based on acrylamide being added and the pulp thus obtained being drained after thorough mixing.

According to the process disclosed in EP-A-0 235 893 for the production of paper, first a substantially linear synthetic cationic polymer having a molar mass of more than 500 000 is first metered to an aqueous fiber suspension in an amount of more than 0.03% by weight, based on dry paper stock, the mixture is then subjected to the action of a shear field, the initially formed flocks being divided into microflocks which carry a cationic charge, bentonite then being metered and the pulp thus obtained being drained without further action of shear forces.

EP-A-0 335 575 describes a papermaking process in which two different water-soluble, cationic polymers are added in succession to the pulp, and the pulp is then subjected to at least one shearing stage and is then flocculated by addition of bentonite.

EP-A-0 885 328 describes a process for the production of paper, a cationic polymer first being metered into an aqueous fiber suspension, the mixture then being subjected to the action of a shear field, an activated bentonite dispersion then being added and the pulp thus obtained being drained.

EP-A 0 711 371 discloses a further process for the production of paper. In this process, a synthetic, cationic, high molecular weight polymer is added to a thick stock cellulosic suspension. After dilution of the flocculated thick stock and before drainage, a coagulant which consists of an inorganic coagulant and/or a second, low molecular weight and highly cationic water-soluble polymer is added.

EP-A-0 910 701 describes a process for the production of paper and cardboard, a low molecular weight or medium molecular weight cationic polymer based on polyethylenimine or polyvinylamine and then a high molecular weight cationic polymer, such as polyacrylamide, polyvinylamine or cationic starch, being added in succession to the paper pulp. After this pulp has been subjected to at least one shearing stage, it is flocculated by adding bentonite and the paper stock is drained.

EP-A-0 608 986 discloses the metering of a cationic retention aid into the thick stock in papermaking. A further process for the production of paper and cardboard is disclosed in U.S. Pat. No. 5,393,381, WO-A-99/66130 and WO-A-99/63159, a microparticle system comprising a cationic polymer and bentonite likewise being used. The cationic polymer used is a water-soluble, branched polyacrylamide.

WO-A-01/34910 describes a process for the production of paper, in which a polysaccharide or a synthetic, high molecular weight polymer is metered into the paper stock suspension. Mechanical shearing of the paper stock must then be carried out. The reflocculation is effected by metering an inorganic component, such as silica, bentonite or clay, and a water-soluble polymer.

U.S. Pat. No. 6,103,065 discloses a process for improving the retention and the draining of paper stocks, a cationic polymer having a molar mass of from 100 000 to 2 million and a charge density of more than 4.0 meq/g being added to the paper stock after the final shearing, a polymer having a molar mass of at least 2 million and a charge density of less than 4.0 meq/g being added simultaneously or thereafter and bentonite then being metered. In this process, it is not necessary to subject the paper stock to shearing after the addition of the polymer. After the addition of the polymer and of the bentonite, the pulp can be drained with sheet formation without the further action of shear forces.

In the known papermaking processes, in which a microparticle system is used as a retention aid, relatively large amounts of polymer and bentonite are required. Those processes in which the presence of cationic polymers having a charge density of more than 4.0 is absolutely essential give papers which tend to yellow.

It is an object of the present invention to provide a further process for the production of paper with the use of a microparticle system, smaller amounts of polymer and bentonite being required in comparison with the known processes and at the same time improved retention and drainage being achieved and papers which have less tendency to yellowing being obtained.

We have found that this object is achieved, according to the invention, by a process for the production of paper, board and cardboard by shearing the paper stock, adding a microparticle system comprising a cationic polymer and a finely divided inorganic component to the paper stock after the last shearing stage before the head box, draining the paper stock with sheet formation and drying the sheets, if cationic polyacrylamides, polymers containing vinylamine units and/or polydiallyldimethylammonium chloride having an average molar mass Mw of in each case at least 500 000 Dalton and a charge density of in each case not more than 4.0 meq/g are used as cationic polymers of the microparticle system, the microparticle system used as a retention aid being free of polymers having a charge density of more than 4 meq/g.

All paper grades, for example cardboard, single-layer/multilayer folding boxboard, single-layer/multilayer liner, fluting medium, papers for newsprint, medium writing and printing papers, natural gravure papers and light-weight coating papers, can be produced by the novel process. To produce such papers, it is possible to start, for example, from groundwood, thermomechanical pulp (TMP), chemothermomechanical pulp (CTMP), pressure groundwood (PGW), mechanical pulp and sulfite and sulfate pulp. The pulps may be both short-fiber and long-fiber. Wood-free grades which give very white paper products are preferably produced by the novel process.

The papers can, if required, contain up to 40, in general from 5 to 35, % by weight of fillers. Suitable fillers are, for example, titanium dioxide, natural and precipitated chalk, talc, kaolin, satin white, calcium sulfate, barium sulfate, clay and alumina.

According to the invention, the microparticle system consists of a cationic polymer and a finely divided anionic component. Suitable cationic polymers are cationic polyacrylamides, polymers containing vinylamine units, polydiallyldimethylammonium chlorides or mixtures thereof, having an average molar mass Mw of, in each case, at least 500 000 Dalton and a charge density of, in each case, not more than 4.0 meq/g. Cationic polyacrylamides having an average molar mass Mw of at least 5 million Dalton and a charge density of from 0.1 to 3.5 meq/g and polyvinylamines which are obtainable by hydrolysis of polymers containing vinylformamide units are particularly preferred, the degree of hydrolysis of the vinylformamide units being from 20 to 100 mol % and the average molar mass of the polyvinylamines being at least 2 000 000 Dalton. The polyvinylamines are preferably prepared by hydrolysis of homopolymers of vinylformamide, the degree of hydrolysis being, for example, from 70 to 95%.

Cationic polyacrylamides-are, for example, copolymers which are obtainable by copolymerization of acrylamide and at least one di-C1- to C2-alkylamino-C2- to C4-alkyl (meth) acrylate or a basic acrylamide in the form of the free bases, of the salts with organic or inorganic acids or of the compounds quaternized with alkyl halides. Examples of such compounds are dimethylaminoethyl methacrylate, diethylaminoethyl methacrylate, dimethylaminoethyl acrylate, diethylaminoethyl acrylate, dimethylaminopropyl methacrylate, dimethylaminopropyl acrylate, diethylaminopropyl methacrylate, diethylaminopropyl acrylate and/or dimethylaminoethylacrylamide. Further examples of cationic polyacrylamides and polymers containing vinylamine units are described in the publications mentioned in connection with the prior art, such as EP-A-0 910 701 and U.S. Pat. No. 6,103,065. Both linear and branched polyacrylamides may be used. Such polymers are commercial products. Branched polymers, which can be prepared, for example, by copolymerization of acrylamide or methacrylamide with at least one cationic monomer in the presence of small amounts of crosslinking agents, are described, for example, in the publications U.S. Pat. No. 5,393,381, WO-A-99/66130 and WO-A-99/63159 mentioned in connection with the prior art.

Further suitable cationic polymers are polydiallyldimethylammonium chlorides (polyDADMAC) having an average molar mass of at least 500 000, preferably at least 1 million, Dalton. Polymers of this type are commercial products.

The cationic polymers of the microparticle system are added to the paper stock in an amount of from 0.005 to 0.5, preferably from 0.01 to 0.2, % by weight.

Suitable inorganic components of the microparticle system are, for example, bentonite, colloidal silica, silicates and/or calcium carbonate. Colloidal silica is to be understood as meaning products which are based on silicates, e.g. silica microgel, silica sol, polysilicates, aluminum silicates, borosilicates, polyborosilicates, clay or zeolites. Calcium carbonate can be used, for example, in the form of chalk, milled calcium carbonate or precipitated calcium carbonate as the inorganic component of the microparticle system. Bentonite is generally understood as meaning sheet silicates which are swellable in water. These are in particular the clay mineral montmorillonite and similar clay minerals, such as nontronite, hectorite, saponite, sauconite, beidellite, allervardite, illite, halloysite, attapulgite and sepiolite. These sheet silicates are preferably activated prior to their use, i.e. converted into a form swellable in water, by treating the sheet silicates with an aqueous base, such as aqueous solutions of sodium hydroxide, potassium hydroxide, sodium carbonate or potassium carbonate. A preferably used inorganic component of the microparticle system is bentonite in the form treated with sodium hydroxide solution. The platelet diameter of the bentonite dispersed in water, in the form treated with sodium hydroxide solution, is for example from 1 to 2 μm and the thickness of the platelets is about 1 nm. Depending on type and activation, the bentonite has a specific surface area of from 60 to 800 $m^2/g$. Typical bentonites are described, for example, in EP-B-0235893. In the papermaking process, bentonite is added to the cellulose suspension typically in the form of an aqueous bentonite slurry. This bentonite slurry may contain up to 10% by weight of bentonite. Usually, the slurries contain about 3-5% by weight of bentonite.

The colloidal silica used may be a product from the group consisting of silicon-based particles, silica microgels, silica sols, aluminum silicates, borosilicates, polyborosilicates and zeolites. These have a specific surface area of 50-1 000 $m^2/g$ and an average particle size distribution of 1-250 nm, usually 40-100 nm. The preparation of such components is described, for example, in EP-A-0041056, EP-A-0185068 and U.S. Pat. No. 5,176,891.

Clay or kaolin is a water-containing aluminum silicate having a lamellar structure. The crystals have a layer structure and an aspect ratio (ratio of diameter to thickness) of up to 30:1. The particle size is such that at least 50% of the particles are smaller than 2 μm.

Carbonates used, preferably calcium carbonate, may be ground calcium carbonate (GCC) or precipitated calcium carbonate (PCC). GCC is prepared by milling and classification processes with the use of milling assistants. It has a particle size such that 40-95% of the particles are smaller than 2 μm, and the specific surface area is 6-13 $m^2/g$. PCC is prepared by passing carbon dioxide into calcium hydroxide solution. The average particle size is 0.03-0.6 μm and the specific surface area can be greatly influenced by the choice of the precipitation conditions. It is 6-13 $m^2/g$.

The inorganic component of the microparticle system is added to the paper stock in an amount of from 0.01 to 1.0, preferably from 0.1 to 0.5, % by weight.

The consistency of the pulp is, for example, from 1 to 100, preferably from 4 to 30, g/l. The aqueous fiber suspension is subjected to at least one shearing stage. It passes through at least one cleaning, mixing and/or pumping stage. Shearing of the pulp can be effected, for example, in a pulper, screen or refiner. After the final shearing stage and before the head box, according to the invention, the microparticle system is metered onto the wire. A procedure in which first the cationic polymer and then the inorganic component of the microparticle system is metered into the paper stock, which has been subjected to shearing beforehand, is particularly preferred here. However, it is also possible to meter first the inorganic component of the microparticle system and then the cationic polymer or to add both components simultaneously to the paper stock. Draining of the paper stock is then carried out without further action of shear forces on a wire with sheet formation. The paper sheets are then dried.

In addition to the microparticle system, the process chemicals usually used in papermaking can be added to the paper stock in the conventional amounts, for example fixing agents, dry and wet strength agents, engine sizes, biocides and/or dyes.

Compared with the known processes, the novel process achieves an increase in the retention of fines and fillers and of process chemicals, such as starch, dyes and wet strength agents, and an improvement in the draining rate, without adversely affecting the formation and paper properties. Moreover, a substantial improvement in the fiber recovery and hence in the relief of the wastewater treatment plant is achieved.

In the examples, percentages are by weight, unless evident otherwise from the context.

The first pass retention (FP retention) was determined by calculating the ratio of the solids content in the white water to the solids content in the head box. It is stated in percent.

The FPA retention (first pass ash retention) was determined analogously to the FP retention, but only the ash content was taken into account.

EXAMPLE 1

A paper stock comprising a wood-free, bleached pulp having a consistency of 7 g/l and a filler content of 30% of calcium carbonate was processed on a Fourdrinier machine with a hybrid former to give a paper of writing and printing quality. The following arrangement of mixing and shearing means was used: mixing chest, dilution to 7 g/l, mixing pump, cleaner, head box pump, screen and head box. 32 t of paper were produced per hour.

After the screen (last shearing stage before the head box), first 270 g/t of a commercial high molecular weight, cationic polyacrylamide. (Polymin PR 8140, average molar mass Mw 7 million) and 2 500 g/t of bentonite were metered. The FP retention was 81.5% and the FPA retention 60.2%.

Comparative Example 1

The example was repeated with the exceptions that 410 g/t of the cationic polyacrylamide were metered before the screen and the pump and 3 000 g/t of bentonite after the screen and before the head box. These amounts were required in order to achieve a formation just as good as in the example. The FP retention here was 79.9% and the FPA retention 59.1%.

As shown by a comparison of the results of the example with the results of the comparative example, the saving of polymer was 30% and the saving of bentonite 17%. With equally good formation, it was possible in the example according to the invention to achieve an improvement in the retention. The improvement in the drainage over the wire was about 10%.

EXAMPLE 2

A wood-containing paper stock comprising groundwood and chemical pulp and having a consistency of 7 g/l and a filler content of 30% of a mixture of clay and calcium carbonate (1:1) was processed on a paper machine with a gap former to give a paper of LWC quality. The following arrangement of mixing and shearing means was used: mixing chest, dilution, decolator, pump, screen, head box. 30 t of paper were produced per hour.

After the screen (final shearing stage before the head box), first 200 g/t of a-commercial high molecular weight cationic polyacrylamide (Polymin KP 2520, average molar mass Mw 5 million) and 1 400 g/l of bentonite were metered. The FP retention was 69% and the FPA retention 40%.

Comparative Example 2

Example 2 was repeated with the exceptions that 280 g/t of the cationic polyacrylamide were metered before the pump and the screen and 1 400 g/t of bentonite after the screen and before the head box. This amount was required in order to achieve an equally good retention. The FP retention here was 69% and the FPA retention 40%.

As shown by a comparison of the results of example 2 with the results of comparative example 2, the saving of polymer was about 30%. Although a smaller amount of retention aid was used in example 2 than in comparative example 2, it was possible to achieve equally good formation and paper properties in example 2.

We claim:

1. A process for the production of paper, board or cardboard, said process comprising:

shearing a paper stock, adding a microparticle system comprising a cationic polymer and a finely divided inorganic component to the paper stock in a retention aid effective amount (1) after the last shearing stage before a head box, draining the paper stock and forming a sheet, and drying said sheet, wherein said cationic polymer is a cationic polyacrylamide having an average molar mass Mw of at least 5 million Dalton and a charge density of from 0.1 to 3.5 meq/g and the microparticle system is free of one or more polymers having a charge density of more than 4 meq/g.

2. A process as claimed in claim 1, wherein the cationic polymer of the microparticle system is added to the paper stock in an amount of from 0.005 to 0.5% by weight, based on dry paper stock.

3. A process as claimed in claim 1, wherein the cationic polymer of the microparticle system is added to the paper stock in an amount of from 0.01 to 0.2% by weight, based on dry paper stock.

4. A process as claimed in claim 1, wherein said inorganic component is at least one material selected from the group consisting of bentonite, colloidal silica, silicate, calcium carbonate, and mixtures thereof.

5. A process as claimed in claim 1, wherein the inorganic component of the microparticle system is added to the paper stock in an amount of from 0.01 to 1.0% by weight, based on dry paper stock.

6. A process as claimed in claim 1, wherein the inorganic component of the microparticle system is added to the paper stock in an amount of from 0.1 to 0.5% by weight, based on dry paper stock.

7. A process as claimed in claim 1, wherein the cationic polymer is metered into the paper stock and then the inorganic component of the microparticle system is metered into the paper stock.

8. A process as claimed in claim 1, wherein said retention aid effective amount (1) provides a particular first pass retention (FP) and a particular first pass ash retention (FPA), and wherein said amount (1) provides the same or substantially the same FP and FPA when the microparticle system is added in an amount (2), except that the cationic polymer portion of the microparticle system in amount (2) is added before said last shearing stage, wherein amount (1) is less than amount (2).

* * * * *